US011629679B2

(12) United States Patent
Leute et al.

(10) Patent No.: US 11,629,679 B2
(45) Date of Patent: Apr. 18, 2023

(54) FUEL INJECTOR

(71) Applicant: Transportation IP Holdings, LLC, Norwalk, CT (US)

(72) Inventors: Pisey Leute, Waterford, PA (US); Justin Thomas Brumberg, Slippery Rock, PA (US); Jesse Brigden, Westfield, PA (US)

(73) Assignee: Transportation IP Holdings, LLC, Norwalk, CT (US)

( * ) Notice: Subject to any disclaimer, the term of this patent is extended or adjusted under 35 U.S.C. 154(b) by 0 days.

(21) Appl. No.: 17/354,699

(22) Filed: Jun. 22, 2021

(65) Prior Publication Data

US 2022/0403806 A1 Dec. 22, 2022

(51) Int. Cl.

| | |
|---|---|
| ***F02M 61/10*** | (2006.01) |
| ***F02M 61/16*** | (2006.01) |
| ***F02M 51/06*** | (2006.01) |

(52) U.S. Cl.

CPC ..... *F02M 61/10* (2013.01); *F02M 51/061* (2013.01); *F02M 61/165* (2013.01); *F02M 2200/40* (2013.01)

(58) Field of Classification Search

CPC .... F02M 61/10; F02M 51/061; F02M 61/165; F02M 2200/40

USPC ..... 123/467

See application file for complete search history.

(56) References Cited

U.S. PATENT DOCUMENTS

| | | | | |
|---|---|---|---|---|
| 2004/0163621 | A1* | 8/2004 | Stockner | F02M 57/025 123/322 |
| 2016/0319794 | A1* | 11/2016 | Duru | F02M 61/165 |
| 2018/0238286 | A1* | 8/2018 | Huettner | F02M 63/0015 |
| 2021/0340943 | A1* | 11/2021 | Tsukada | F02M 51/061 |

* cited by examiner

*Primary Examiner* — Yi-Kai Wang

(74) *Attorney, Agent, or Firm* — McCoy Russell LLP

(57) ABSTRACT

A configuration is provided for a fuel injector for a common rail fuel system. In one example, the fuel injector may include a housing, an inner chamber enclosed by the housing, and a flow limiting valve. The flow limiting valve may be arranged at a downstream end of the inner chamber and also enclosed by the housing. This configuration may allow the fuel injector housing to have sufficient wall strength to withstand high pressure fuel injection and may allow effective fuel supply cut off when fuel cut off is demanded.

20 Claims, 4 Drawing Sheets

FUEL INJECTOR

FIELD

Embodiments of the subject matter disclosed herein relate to a fuel injector for a common rail fuel system.

BACKGROUND

A common rail fuel system, including high pressure fuel injectors, provides each of a plurality of engine combustion chambers with optimized fuel injection with the fuel injection timing controlled by an engine control unit (ECU). Physical properties of the fuel injector, such as control over injection volume, an ability to efficiently vaporize fuel, a heat tolerance, a pressure tolerance, etc., may be at least partly dependent on a structural configuration of the fuel injector. For example, a material and a thickness of a housing of the fuel injector may be selected based on anticipated high pressures generated in the common rail fuel system and high temperatures resulting from fuel combustion at the engine.

The fuel injector may include several inner components enclosed within a rigid housing, including a flow limiting valve configured to cut off fuel injection upon detection of an overfueling event, a filter to remove debris and other particles from the fuel flow, and a solenoid valve to control a fuel injection timing.

The flow limiting valve may be housed in an upstream portion of the fuel injector, proximal to a fuel inlet, e.g., a fuel injector head. In such an arrangement, the flow limiting valve may occupy an undesirably large volume within the fuel injector head. Furthermore, a support mechanism that encircles the fuel injector, such as a clamp, may be used at the head to maintain a position of the fuel injector in an engine block. Thus, an outer diameter of the fuel injector housing at the head may be reduced to accommodate application of the clamp while adhering to a maximum allowable diameter of a fuel injector housing determined based on a diameter of a bore in which the fuel injector is seated. This may result in a decrease in a wall thickness of the housing at the fuel injector head. However, reducing the wall thickness of the fuel injector housing may degrade a fatigue strength and pressure tolerance of the housing.

BRIEF DESCRIPTION OF THE INVENTION

Inventors herein have recognized these challenges and propose a fuel injector comprising a housing, an inner chamber enclosed by the housing, and a flow limiting valve arranged at a downstream end of the inner chamber and also enclosed by the housing wherein the flow limiting valve is positioned between the downstream end of the inner chamber and a solenoid valve. This positioning of the flow limiting valve may minimize or at least partially alleviate a wall thickness reduction of the housing at a fuel injector head. As such, the fuel injector housing may have sufficient wall strength to withstand high pressure fuel injection at all regions of the housing. Additionally, situating the flow limiting valve downstream of the filter may help remove debris and other particles from the fuel flow before the fuel reaches the flow limiting valve, thereby prolonging a useful life of the flow limiting valve.

Furthermore, a specific positioning of the flow limiting valve directly coupled to the solenoid control valve without a fluid reservoir in between may minimize a residual volume of fuel emptied into a cylinder during an unintended overfueling event prior to activation of the flow limiting valve, thus effectively cutting off fuel supply to the cylinder when fuel cutoff is demanded.

BRIEF DESCRIPTION OF THE DRAWINGS

The present invention will be better understood from reading the following description of non-limiting embodiments, with reference to the attached drawings, wherein below.

DETAILED DESCRIPTION

Figure 1:
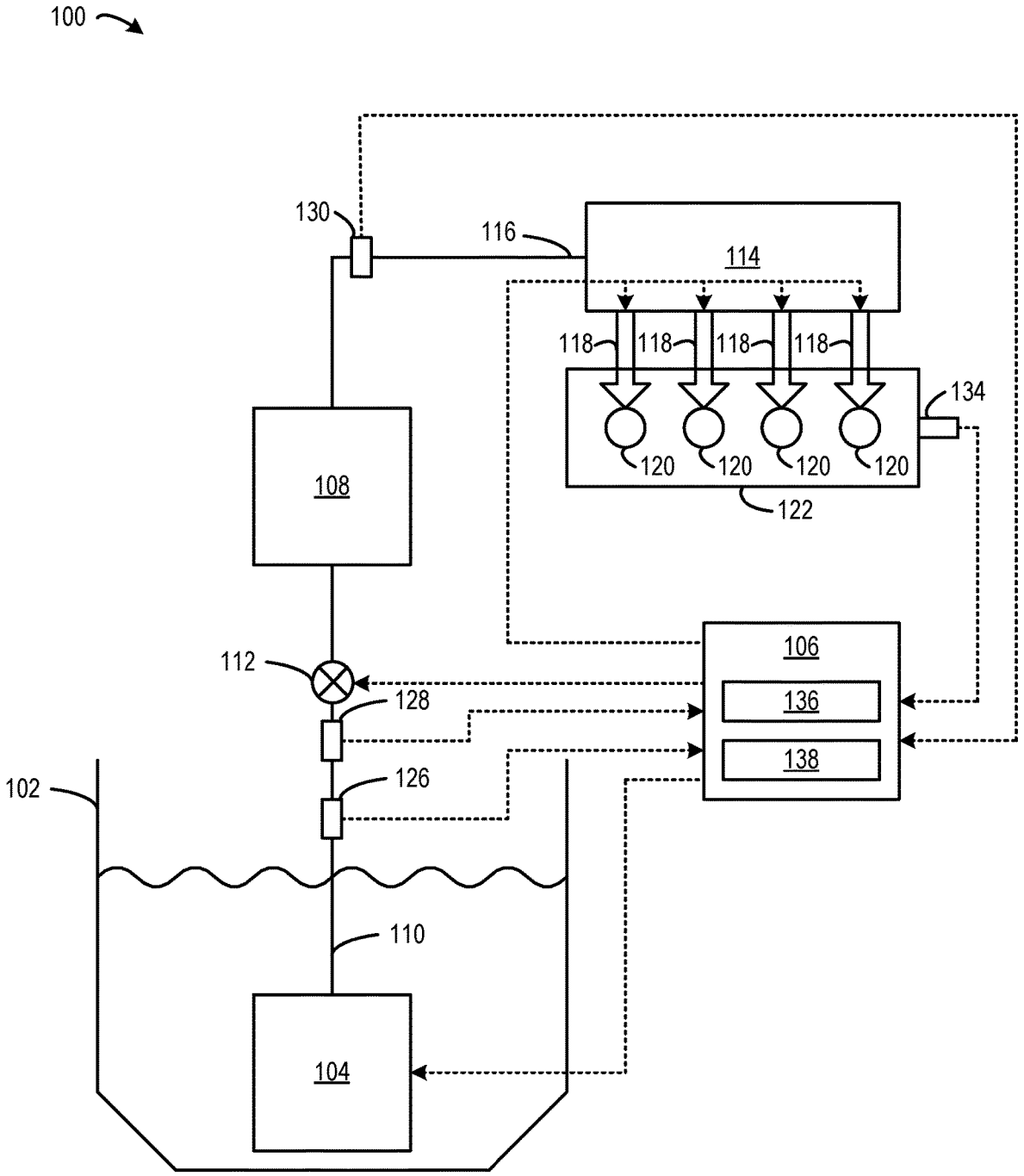
FIG. 1 shows a schematic diagram of a common rail fuel system for an engine of a rail vehicle.
Figure 2:
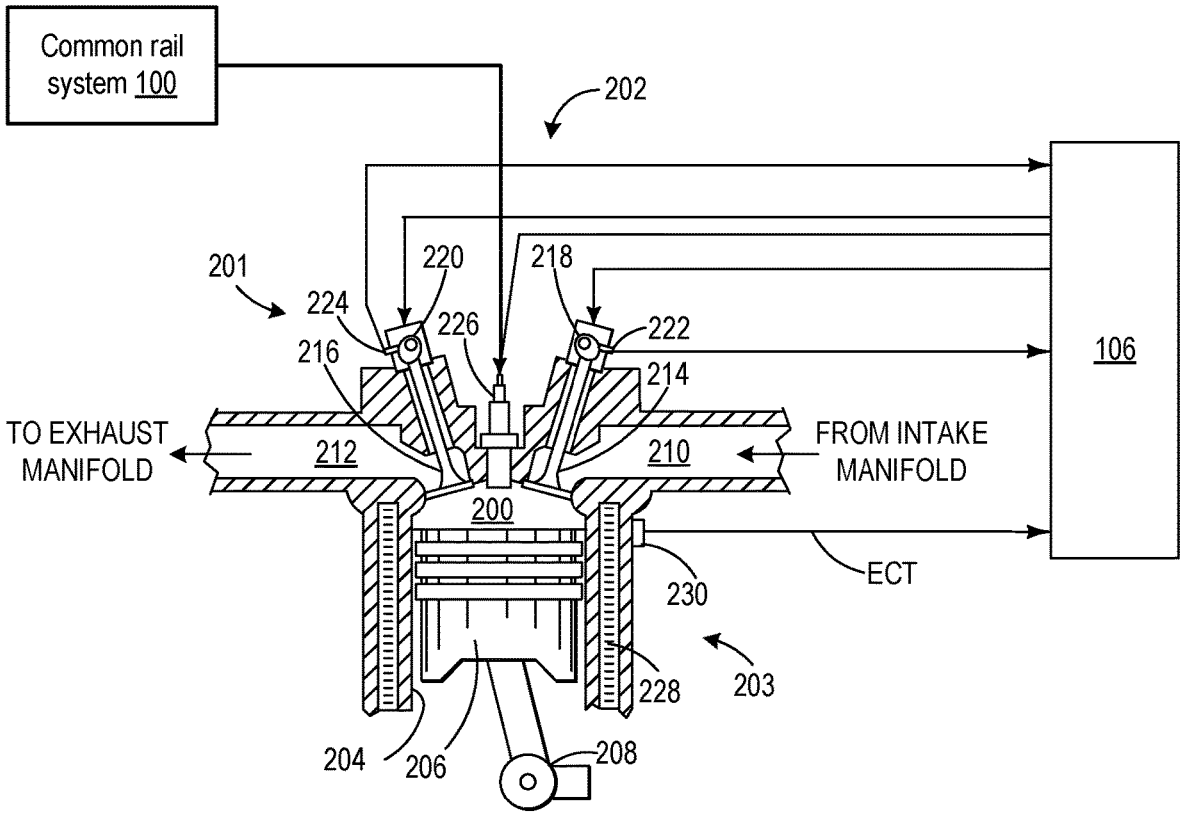
FIG. 2 shows a diagram of a combustion chamber of a multi-cylinder internal combustion engine, which may be coupled to the common rail fuel system of FIG. 1.
Figure 3:
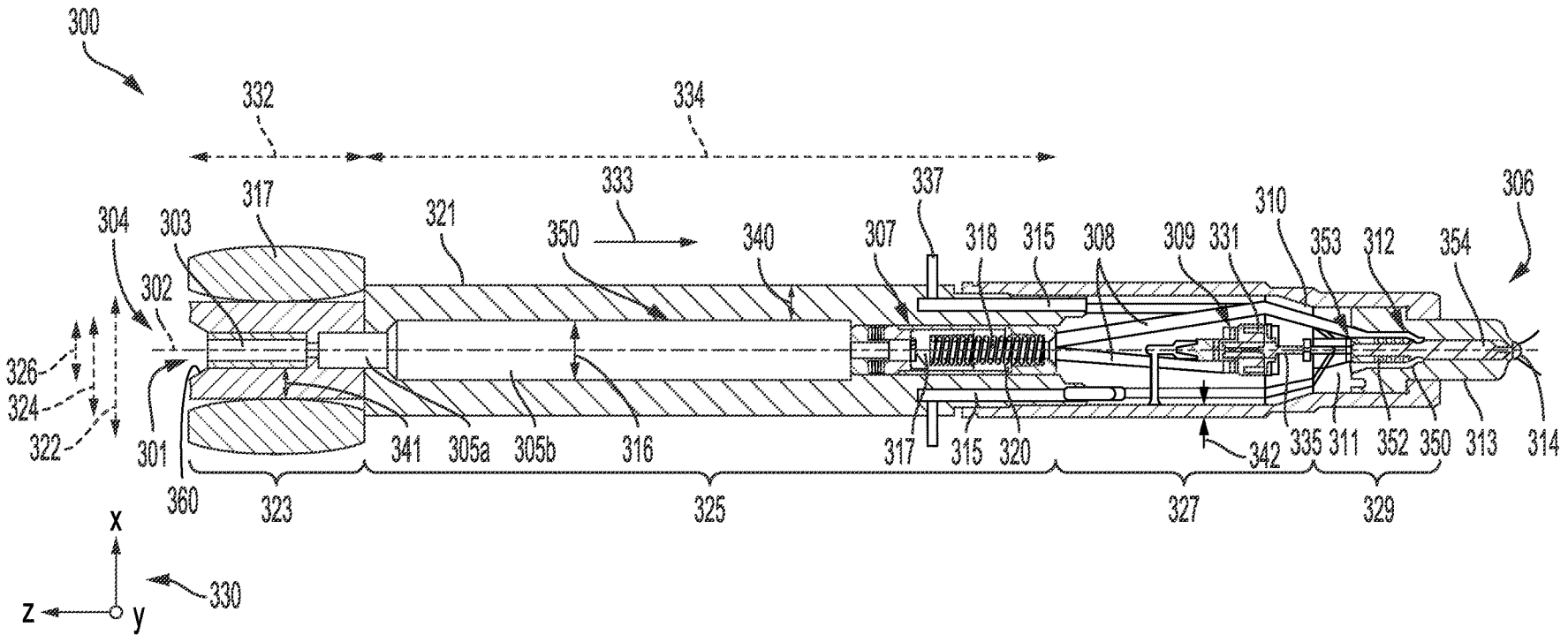
FIG. 3 shows a cross-section of a high pressure fuel injector, which may be implemented at the combustion chamber of FIG. 2.
Figure 4:
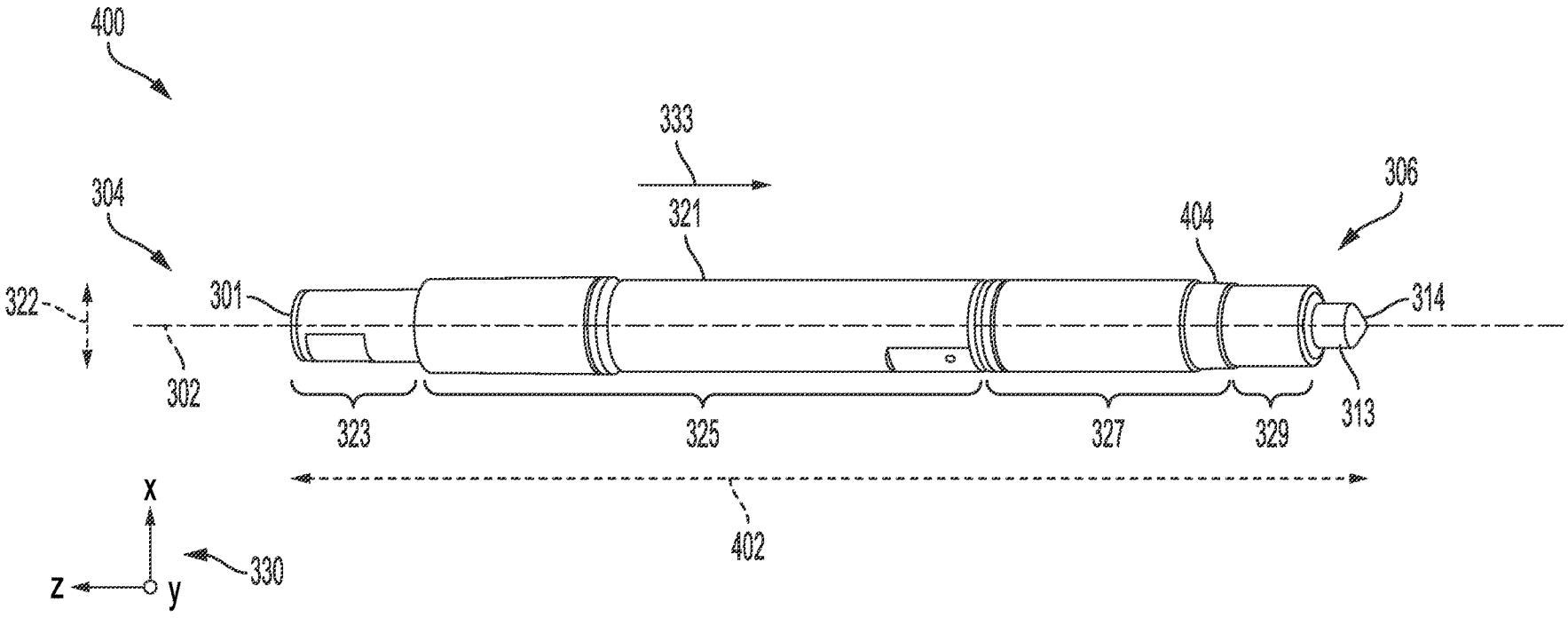
FIG. 4 shows a perspective view of an exterior of the high pressure fuel injector of FIG. 3.

The following description relates to a fuel injector for a common rail fuel system. In one example, the fuel injector may be arranged in the common rail fuel system for an engine of a rail vehicle, as shown in FIG. 1. Fuel from the fuel injector of the common rail fuel system may be injected into a combustion chamber, or cylinder, of a multi-cylinder internal combustion engine, as shown in FIG. 2, coupled to the common rail system of FIG. 1. FIGS. 3 and 4 depict an embodiment of a fuel injector configured with the advantages described above, which may be implemented at a cylinder such as the cylinder of FIG. 2. FIG. 3 shows a cross-section of the fuel injector and FIG. 4 shows a perspective view of an exterior of the fuel injector.

FIGS. 3-4 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

An example of a fuel system for an engine is disclosed. For example, FIG. 1 shows a block diagram of a common rail fuel system (CRS) 100 for an engine 122 of a vehicle, such as a rail vehicle. Liquid fuel, such as diesel fuel, is sourced or stored in a fuel tank 102. A low-pressure fuel pump 104 is in fluid communication with the fuel tank 102. In the embodiment shown in FIG. 1, the low-pressure fuel pump 104 is disposed inside of the fuel tank 102 and can be immersed below the liquid fuel level. In alternative embodiments, the low-pressure fuel pump may be coupled to the outside of the fuel tank and pump fuel through a suction device. Operation of the low-pressure fuel pump 104 is regulated by a controller 106.

Liquid fuel is pumped by the low-pressure fuel pump 104 from the fuel tank 102 to a high-pressure fuel pump 108 through a conduit 110. A valve 112 is disposed in the conduit 110 and regulates fuel flow through the conduit 110. For example, the valve 112 may be an inlet metering valve (IMV). The IMV 112 is disposed upstream of the high-pressure fuel pump 108 to adjust a flow rate of fuel that is provided to the high-pressure fuel pump 108 and further to a common fuel rail 114 for distribution to a plurality of fuel injectors 118 for fuel injection. For example, the IMV 112 may be a solenoid valve, opening and closing of which is regulated by the controller 106. In other words, the controller 106 commands the IMV to be fully closed, fully open, or a position in between fully closed and fully opened in order to control fuel flow to the high-pressure fuel pump 108 to a commanded fuel flow rate. During operation of the vehicle, the IMV 112 is adjusted to meter fuel based on operating conditions, and during at least some conditions may be at least partially open. It is to be understood that the valve is merely one example of a control device for metering fuel and any suitable control element may be employed without departing from the scope of this disclosure. For example, a position or state of the IMV may be electrically controlled by controlling an IMV electrical current. As another example, a position or state of the IMV may be mechanically controlled by controlling a servo motor that adjusts the IMV.

The high-pressure fuel pump 108 increases fuel pressure from a lower pressure to a higher pressure. The high-pressure fuel pump 108 is fluidly coupled with the common fuel rail 114. The high-pressure fuel pump 108 delivers fuel to the common fuel rail 114 through a conduit 116. A plurality of fuel injectors 118 are in fluid communication with the common fuel rail 114. Each of the plurality of fuel injectors 118 delivers fuel to one of a plurality of engine cylinders 120 in the engine 122. Fuel is combusted in the plurality of engine cylinders 120 to provide power to the vehicle through an alternator and traction motors, for example. Operation of the plurality of fuel injectors 118 is regulated by the controller 106. In the embodiment of FIG. 1, the engine 122 includes four fuel injectors and four engine cylinders. In alternate embodiments, more or fewer fuel injectors and engine cylinders can be included in the engine.

The plurality of fuel injectors 118 may be configured to inject fuel at high pressures communicated from the high-pressure fuel pump 108 via the common fuel rail 114. Flow of fuel to the plurality of engine cylinders 120 may be controlled by operation of the plurality of fuel injectors 118. For example, inner components of each fuel injector may include a solenoid valve which adjusts an opening of the fuel injector to allow fuel to flow therethrough when actuated. Furthermore, the inner components of the fuel injector may include a flow limiting valve configured to cut off fuel flow when an overfueling event is detected by a pressure drop that may exceed a nominal pressure drop across the flow limiting valve during fueling, where the nominal pressure drop is a decrease in pressure that occurs during an optimized combustion behavior. The overfueling event may be a condition where an excess of fuel is injected relative to a target fueling quantity required for the optimized combustion behavior within a cylinder. The excess fuel injection may occur due to, for example, a degraded fuel injector, a calculation error at the controller 106, degraded sensors, etc. By incorporating the flow limiting valve in the fuel injector, adverse effects of the overfueling event, such as a cylinder over-pressurizing event (increased fueling in the combustion chamber) or hydrolock (where a volume of delivered fuel is greater than a cylinder volume when the cylinder volume is at a minimum), may be at least partially mitigated. Further details of the flow limiting valve, as well as other inner components of the fuel injector, are described further below, with reference to FIGS. 3-4.

Fuel pumped from the fuel tank 102 to an inlet of the IMV 112 by the low-pressure fuel pump 104 may operate at what is referred to as a lower fuel pressure or engine fuel pressure. Correspondingly, components of the CRS 100 which are upstream of the high-pressure fuel pump 108 operate in a lower fuel pressure or engine fuel pressure region. On the other hand, the high-pressure fuel pump 108 may pump fuel from the lower fuel pressure to a higher fuel pressure or rail fuel pressure. Correspondingly, components of the CRS 100 which are downstream of the high-pressure fuel pump 108 are in a higher-fuel pressure or rail fuel pressure region of the CRS 100.

A fuel pressure in the lower fuel pressure region is measured by a pressure sensor 126 that is positioned in the conduit 110. The pressure sensor 126 sends a pressure signal to the controller 106. In an alternative application, the pressure sensor 126 is in fluid communication with an outlet of the low-pressure fuel pump 104. A fuel temperature in the lower fuel pressure region is measured by a temperature sensor 128 that is positioned in conduit 110. The temperature sensor 128 sends a temperature signal to the controller 106.

A fuel pressure in the higher fuel pressure region is measured by a pressure sensor 130 that is positioned in the conduit 116. The pressure sensor 130 sends a pressure signal to the controller 106. The controller 106 uses this pressure signal to determine a rail pressure of fuel (e.g., FRP) in the common fuel rail. As such, the fuel rail pressure (FRP) is provided to the controller 106 by the pressure sensor 130. In an alternative application, the pressure sensor 130 is in fluid communication with an outlet of the high-pressure fuel pump 108. Note that in some applications various operating parameters may be generally determined or derived indirectly in addition to or as opposed to being measured directly.

In addition to the sensors mentioned above, the controller 106 receives various signals from a plurality of engine sensors 134 coupled to the engine 122 that may be used for assessment of fuel control health and associated engine operation. For example, the controller 106 receives sensor signals indicative of air-fuel ratio, engine speed, engine load, engine temperature, ambient temperature, fuel value, a number of cylinders actively combusting fuel, and the like. In the illustrated implementation, the controller 106 is a computing device, such as a microcomputer that includes a processor unit 136, non-transitory computer-readable storage medium device 138, input/output ports, memory, and a data bus. The computer-readable storage medium 138 included in the controller 106 is programmable with computer readable data representing instructions executable by the processor for performing the control routines and methods described below as well as other variants that are not specifically listed.

FIG. 2 depicts an embodiment of a combustion chamber, or cylinder 200, of a multi-cylinder internal combustion engine 202, which may be coupled to a common rail fuel system as described above with reference to FIG. 1. In one example, the engine 202 may be an embodiment of the engine 122 of FIG. 1 and the cylinder 200 may represent each of the plurality of cylinders 120 of FIG. 1. The cylinder 200 may be defined by a cylinder head 201, housing an intake valve 214, an exhaust valve 216, a liquid fuel injector 226, described below, and a cylinder block 203.

The engine 202 may be controlled at least partially by a control system including controller 106 which may be in further communication with a vehicle system. As described above, the controller 106 may further receive signals from various engine sensors including, but not limited to, engine speed, engine load, boost pressure, exhaust pressure, turbocharger speed, ambient pressure, $CO_2$ levels, exhaust temperature, NOx emission, engine coolant temperature (ECT) from temperature sensor 230 coupled to cooling sleeve 228, etc. Correspondingly, the controller 106 may control an engine system by sending commands to various components such as alternator, cylinder valves, throttle, fuel injectors, etc.

The cylinder 200 (i.e., combustion chamber) may include a cylinder liner 204 with a piston 206 positioned therein. The piston 206 may be coupled to a crankshaft 208 so that reciprocating motion of the piston is translated into rotational motion of the crankshaft. The crankshaft may include a crankshaft speed sensor for outputting a speed (e.g., instantaneous speed) of the crankshaft. In some embodiments, the engine may be a four-stroke engine in which each of the cylinders fires in a firing order during two revolutions of the crankshaft. In other embodiments, the engine may be a two-stroke engine in which each of the cylinders fires in a firing order during one revolution of the crankshaft.

The cylinder 200 receives intake air for combustion from an intake including an intake passage 210. The intake passage 210 receives intake air via an intake manifold. The intake passage 210 may communicate with other cylinders of the engine in addition to the cylinder 200, for example, or the intake passage may communicate exclusively with the cylinder 200.

Exhaust gas resulting from combustion in the engine 202 is supplied to an exhaust including an exhaust passage 212. Exhaust gas flows through the exhaust passage, to a turbocharger in some embodiments (not shown in FIG. 2) and to atmosphere, via an exhaust manifold. The exhaust passage 212 may further receive exhaust gases from other cylinders of the engine in addition to the cylinder 200, for example.

Each cylinder of the engine may include one or more intake valves and one or more exhaust valves. For example, the cylinder 200 is shown including at least one of the intake poppet valve 214 and at least one of the exhaust poppet valve 216 located in an upper region of the cylinder 200. In some embodiments, each cylinder of the engine, including the cylinder 200, may include at least two intake poppet valves and at least two exhaust poppet valves located at the cylinder head 201.

The intake valve 214 may be controlled by the controller 106 via an actuator 218. Similarly, the exhaust valve 216 may be controlled by the controller 106 via an actuator 220. During some conditions, the controller 106 may vary the signals provided to the actuators 218, 220 to control the opening and closing of the respective intake and exhaust valves. The position of the intake valve 214 and the exhaust valve 216 may be determined by respective valve position sensors 222 and 224, respectively, and/or by cam position sensors. The valve actuators may be of the electric valve actuation type or cam actuation type, or a combination thereof, for example.

The intake and exhaust valve timing may be controlled concurrently or any of a possibility of variable intake cam timing, variable exhaust cam timing, dual independent variable cam timing or fixed cam timing may be used. In other embodiments, the intake and exhaust valves may be controlled by a common valve actuator or actuation system, or a variable valve timing actuator or actuation system. Further, the intake and exhaust valves may be controlled to have variable lift by the controller based on operating conditions.

In still further embodiments, a mechanical cam lobe may be used to open and close the intake and exhaust valves. Additionally, while a four-stroke engine is described above, in some embodiments a two-stroke engine may be used, where the intake valves are dispensed with and ports in the cylinder wall are present to allow intake air to enter the cylinder as the piston moves to open the ports. This can also extend to the exhaust, although in some examples exhaust valves may be used.

In some embodiments, each cylinder of the engine may be configured with one or more fuel injectors for providing fuel thereto. As a non-limiting example, FIG. 2 shows the cylinder 200 including the fuel injector 226, which may be an example of the plurality of fuel injectors 118 of FIG. 1. The fuel injector 226 is shown coupled directly to the cylinder 200 for injecting fuel directly therein. In this manner, the fuel injector 226 provides what is known as direct injection of a fuel into the cylinder 200. The fuel may be delivered to the fuel injector 226 from, for example, the CRS 100 of FIG. 1. In one example, the fuel is diesel fuel that is combusted in the engine through compression ignition. In other non-limiting embodiments, the fuel may be gasoline, kerosene, biodiesel, or other petroleum distillates of similar density through compression ignition (and/or spark ignition). In one example, the controller 106 may control an amount, duration, timing, and spray pattern of fuel delivered to the cylinder 200 via the fuel injector 226.

A fuel injector may include a flow limiting valve configured to cut off fuel flow when an overfueling event is detected, as previously described. In a conventional fuel injector, the flow limiting valve may be arranged proximate to and immediately downstream of a fuel inlet. In one example, the fuel injector may include a side pipe extending perpendicular to a housing of the fuel injector and fluidly coupled to an inner reservoir or chamber of the fuel injector. Fuel from a common rail system enters the side pipe through the fuel inlet and flows through the flow limiting valve and a filter, positioned downstream of the flow limiting valve, which are both housed in the side pipe. In another example, the fuel injector may not include the side pipe and instead flow fuel directly through elements situated in the housing along a single axis. For example, the fuel injector may have a linear fuel flow path along a longitudinal axis of the fuel injector and the fuel inlet may be located at an extreme upstream point of the linear path. The fuel inlet may be immediately upstream of the flow limiting valve, both the fuel inlet and the flow limiting valve positioned in a fuel injector head. After passing through the flow limiting valve, fuel may flow through the filter arranged downstream of the flow limiting valve and accumulate in the inner chamber before being ejected from the fuel injector during a fuel injection event.

A common rail fuel system may operate under a high pressure, for example, at least 1600 to 1800 bar. To withstand the high pressure requirements of this fuel system, a fuel injector may have inner and outer dimensional constraints. One constraint may be a threshold thickness for a wall of the fuel injector housing, where a distance between an outer diameter and an inner diameter is sufficiently thick to withstand high pressure demands. Additionally, engine systems configured to accommodate single axis fuel injectors may include a cylinder head bore with a diameter configured to house a fuel injector with a similar diameter. Therefore, there may be at least two dimensional constraints for high pressure fuel injectors: the fuel injector must fit within a set fuel injector housing slot in a cylinder head and the wall thickness of the fuel injectors must be sufficiently thick to withstand high pressure fuel injection.

When the flow limiting valve is arranged at an upstream portion of the fuel injector, as, for example, in the single axis fuel injector, the flow limiting valve may occupy an undesirably large volume inside the fuel injector head. Furthermore, the outer diameter at the fuel injector head may be sized to match a maximum allowable diameter of a cylinder head bore and support device (such as a clamp) configured to receive the fuel injector and maintain the fuel injector in place, respectively. Thus, to comply with the constraints imposed on the outer dimensions of the fuel injector while accommodating the positioning of the flow limiting valve, reduction of the wall thickness at the fuel injector head may be demanded. This poses a challenge, however, as reducing the thickness of the fuel injector head may degrade a fatigue strength and pressure tolerance of the fuel injector housing.

Furthermore, a specific positioning of the flow limiting valve within the main body of the fuel injector may affect engine performance and longevity. For example, if fuel is able to accumulate downstream of the flow limiting valve prior to injection, the accumulated fuel may drip into the cylinder during an overfueling event, in spite of the flow limiting valve cutting off fuel flow to the cylinder. This may further exacerbate adverse effects of overfueling.

Inventors herein have recognized these challenges and propose a fuel injector with a flow limiting valve arranged downstream of an inner chamber, positioned between the inner chamber and a solenoid control valve. The flow limiting valve may be directly coupled to the solenoid control valve without a fluid reservoir in between. This may minimize a residual volume of fuel emptied into a cylinder when the flow limiting valve is activated, thus effectively cutting off fuel supply to the cylinder when fuel cutoff is demanded.

By moving the flow limiting valve to a main body of the fuel injector housing, distal from the fuel inlet and downstream from the fuel injector head, a thickness of the fuel injector housing at the head may be increased relative to an embodiment where the flow limiting valve is located in the fuel injector head. As such, both the fuel injector head and fuel injector body have sufficient wall thickness to withstand high pressure fuel injection. Additionally, locating the flow limiting valve downstream of the filter, which has a small enough diameter that situating the filter in the fuel injector head has a minimal effect on wall thickness, may help remove debris and other particles from the fuel flow before the fuel reaches the flow limiting valve, thereby prolonging a useful life of the flow limiting valve.

FIGS. 3 and 4 depict an embodiment of a fuel injector 300, configured with the advantages described above, which may be implemented at a cylinder such as cylinder 200 of FIG. 2. In one example, the fuel injector 300 may be an embodiment of the fuel injector 226 shown in FIG. 2. FIG. 3 shows a cross-section of the fuel injector 300 and FIG. 4 shows a perspective view 400 of an exterior of the fuel injector 300. A set of reference axes 330 is provided for comparison between views, indicating a y-axis, an x-axis, and a z-axis. A central axis of rotation 302 of the fuel injector 300 is also provided which is parallel with the z-axis and may also be a longitudinal axis of the fuel injector 300. Fuel may flow linearly through the fuel injector 300 along the central axis of rotation 302.

As shown in FIG. 4, the fuel injector 300 is comprised of a hollow, cylindrical housing 321 enclosing various inner components of the fuel injector 300, with an inlet end 304 and an outlet end 306 for fuel to enter and exit the fuel injector 300, respectively. The housing 321, may be formed of a metal such as, for example, steel. The housing 321 may have four sections, a fuel injector head 323, a fuel injector body 325, a fuel injector end 327, and a nozzle area 329, which are sequentially arranged (e.g., along a direction of fuel flow) and form a unitary, continuous structure. The fuel injector 300 may also have a nozzle 313, not enclosed by the housing 321, immediately downstream of the nozzle area 329 and protruding from the housing 321 along the central axis of rotation 302. In the following description, notations of upstream and downstream should be understood with respect to fuel flow from the inlet end 304 to the outlet end 306, respectively, as depicted by arrow 333, where an inlet 301 is an extreme upstream element and a nozzle tip 314 is an extreme downstream element. Each housing section and the nozzle 313 may form a different portion of a total length 402, as indicated in FIG. 4, of the fuel injector 300 with the fuel injector body 325 forming a larger portion of the total length 402 than the other sections or the nozzle 313.

A first outer diameter 322, as shown in FIG. 3, of the housing 321 of the fuel injector 300 may be relatively uniform along the fuel injector body 325, the fuel injector end 327, and the nozzle area 329, or can taper. In one example, as depicted in FIG. 4, the first outer diameter 322 of the housing 321 may taper in a downstream direction at a merging region 404 between the fuel injector end 327 and the nozzle area 329 so that the first outer diameter 322 at the nozzle area 329 is reduced compared to the first outer diameter 322 at the fuel injector end 327. For example, the first outer diameter 322 at the nozzle area 329 may be 10% narrower than the first outer diameter 322 at the fuel injector end 327. In other examples, the difference in diameter may be between 5-20%. In yet another example, the difference in diameter may be less than 5% or greater than 20%. In other examples, however, the first outer diameter 322 may be uniform through the fuel injector body 325, the fuel injector end 327, and the nozzle area 329.

A second outer diameter 324 of the housing 321 at the fuel injector head 323 may be narrower than the first outer diameter 322. In one example, the second outer diameter 324 may be 70% of the first outer diameter 322. In other examples, the second outer diameter 324 may between 60-90% of the first outer diameter 322. In yet another example, the difference in diameter may be less than 60% or greater than 90%. The second outer diameter 324 of the housing 321 at the fuel injector head 323 may be reduced compared to the first outer diameter 322 to accommodate a ring-shaped clamp 317, as illustrated in FIG. 3, extending entirely along a length 332 of the fuel injector head 323 and circumferentially surrounding the fuel injector head 323. The clamp 317 may secure the fuel injector 300 at the fuel injector head 323 within a bore of the cylinder configured to receive the fuel injector 300.

The nozzle 313 immediately downstream of the nozzle area 329 is not enclosed by the housing 321 and protrudes from the housing 321 along the central axis of rotation 302. The nozzle 313 may have a third outer diameter 326, which may be narrower than the first outer diameter 322 and the second outer diameter 324 of the housing 321.

The housing 321 has a wall thickness which may be defined as a distance between the outer diameter, (e.g., the first, second, or third outer diameters 322, 324, 326) and an inner diameter of the housing 321. For example, at the fuel injector body 325, the housing 321 may have a first wall thickness 340 which is a half of a difference between the first outer diameter 322 and an inner diameter 316 of the housing 321. At the fuel injector head 323, the housing 321 may have a second wall thickness 341 that is reduced relative to the first wall thickness 340 of the fuel injector body 325. In one example, the first wall thickness 340 may be reduced by up to and including a maximum threshold amount, so that the resulting second wall thickness 341 is thinner than the first wall thickness 340 by an amount equal to or less than a threshold amount. For example, the threshold amount may be 10%. In another example, the threshold amount may be a reduction between 5-25% compared to the initial wall thickness. The second wall thickness 341 is therefore not reduced past a threshold strength and pressure tolerance of the housing 321.

The fuel injector end 327 and the nozzle area 329 may have a third wall thickness 342 that may be reduced and/or increased compared to the first wall thickness 340. In some examples, the third wall thickness 342 may also be less, e.g., thinner, than the second wall thickness 341 at the fuel injector head 323 or more, e.g., thicker, than the second wall thickness 341 at the fuel injector head 323. At a downstream end of the nozzle area 329 proximal to the outlet end 306, the housing 321 bends perpendicular to the central axis of rotation 302 to seal around the nozzle 313, which protrudes from the housing 321 along the central axis of rotation 302. A thickness of the nozzle area 329 that is perpendicular to the axis of rotation 302 may be similar to the third wall thickness 342. The nozzle 313 may be a cylindrical shell formed of a rigid, heat tolerant material, such as a metal. A thickness of the cylindrical shell may be less than each of the first wall thickness 340, the second wall thickness 341, and the third wall thickness 342.

As shown in FIG. 3, inner components of the fuel injector 300, which may be at least partially enclosed by the housing 321, will now be described according to the direction of fuel flow, as indicated by arrow 333. The inner components include the high pressure fuel inlet 301, a filter 303, an inner chamber 305, a flow limiting valve 307, a pair of high pressure fuel passages 308, a solenoid 309, a control valve plate 310, a pair of low pressure leakage bores 315, an orifice plate 311, a nozzle control area 312 (including a nozzle spring 352 and a nozzle needle 354), a nozzle 313, and a nozzle tip 314.

At the inlet end 304 of the fuel injector 300, the fuel injector head 323 houses the fuel inlet 301 and the filter 303. The fuel inlet 301 may be an opening at the inlet end of the fuel injector 300 and may couple the fuel injector 300 to a common rail fuel system, e.g., CRS 100 of FIGS. 1 and 2, to allow high pressure fuel to enter the fuel injector 300. As such, the fuel inlet 301 may be configured to seal against high pressures by a high pressure fuel pipe head 360. The high pressure fuel pipe head 360 may couple the fuel injector 300 to the common rail system, and may have a conical geometry to provide a sealing effect. The conical geometry may be 90 degrees relative to the central axis of rotation 302, in one example. In another example, the angle of the conical geometry, with respect to the central axis of rotation 302 may vary between 60 degrees to 120 degrees. The filter 303 is arranged in the fuel inlet 301 and filters fuel flowing through the fuel injector head 323. The filter 303 may extend along a portion of the length 332 of the fuel injector head 323. For example, the filter 303 may extend along 60% of the length 332 of the fuel injector head 323 but a length of the filter 303 relative to the fuel injector head 323 may vary in other examples. In one example, the filter 303 may be an edge filter, gap filter, or other type of filter, and may prevent debris and other particles from entering elements of the fuel injector 300 downstream of the filter 303 without impeding fuel flow.

The filter 303 may be positioned upstream of the inner chamber 305, herein referred to as an "internal accumulator". The internal accumulator 305 may be a cylindrical chamber with a first portion 305*a* of the chamber situated within the fuel injector head 323 and a second portion 305*b* of the chamber situated in the fuel injector body 325. The second portion 305*b* may be longer, e.g., as defined along the central axis of rotation 302, than the first portion 305*a*. The internal accumulator 305 extends between and fluidly couples the filter 303 to the flow limiting valve 307. The internal accumulator 305 may be a fluid reservoir to store high pressure fuel prior to injection into the cylinder.

The fuel injector body 325 also encloses the flow limiting valve 307 which is positioned downstream of and fluidly coupled to the internal accumulator 305. The flow limiting valve 307 may extend through a portion of a length 334 of the fuel injector body 325, such as 33% or anywhere between 20-40%, and be situated immediately upstream of the fuel injector end 327. The flow limiting valve 307 may be configured to cut off fuel injection when an overfueling event is detected.

In one example, the flow limiting valve 307 may be configured with a housing that encloses a hollow, cylindrical piston 317 and a spring 318. The spring 318 may be positioned inside the piston 317 and may extend along an entire length of the flow limiting valve 307. The piston 317 may be configured with a plurality of three or more flat sides arranged symmetrically around an outer circumference of the piston 317. The plurality of flat sides may provide clearance between the flat sides of the piston 317 and the curved injector body 321, which may allow fuel to flow through the flow limiting valve 307 to the fuel injector end 327. During the fuel injection event, a change in pressure across the flow limiting valve 307 may move the piston 317 downwards towards the fuel injector end 327, as indicated by arrow 333, and compress the spring 318. During the overfueling event, a change in pressure across the flow limiting valve 307 may be sufficient to move the piston 317 to rest against a flow limiter housing seat 320. When the piston 317 is in contact with the flow limiter housing seat 320, fuel flow may be blocked from flowing into the fuel injector end 327.

The flow limiting valve 307 may be reopened when the pressure upstream of the piston 317 is relieved. For example, the piston 317 may return to an upstream position in the flow limiting valve 307 when a spring force of the spring 318 is larger than a force from the upstream pressure. The upstream pressure may be relieved during engine shut down, which may be done either manually or automatically.

The fuel injector end 327 houses the high pressure fuel passages 308, the solenoid 309, the control valve plate 310, and the orifice plate 311. The flow limiting valve 307 in the fuel injector body 325 may be fluidly coupled to the high pressure fuel passages 308 which direct fuel flow around the solenoid 309 through the control valve plate 310. As such the only amount of fuel stored downstream of the flow limiting valve 307 prior to a fuel injection event may be a fuel volume stored in the high pressure fuel passages 308, a control volume 353, and a nozzle volume 350, described below. The high pressure fuel passages 308 and nozzle volume 350 may store a small volume of fuel, such as that, in the event of the nozzle needle 354 being stuck in an open position or the nozzle tip 314 being broken, an undesired volume of fuel may drip into the combustion chamber. In one example, the solenoid valve 309 may be coupled to the control valve plate 310, which in turn may be coupled to the orifice plate 311. The coupling of the solenoid valve 309 with the control valve plate 310 may incorporate several components including a solenoid 331 housed inside the solenoid valve 309 and a piston-like rod 335 (for example, an anchor rod, bolt, etc.), housed inside the control valve plate 310. The orifice plate 311 may be configured with three orifices (not shown). A first orifice may be an inlet orifice that directs high pressure fuel into the control volume 353. A second orifice may be an outlet orifice that directs high pressure fuel out of the control volume 353 into the control valve plate 310 when the solenoid 331 is energized, which may cause the pressure upstream of the top of the nozzle needle 354 to be lower than the pressure at a bottom of the nozzle needle 354. A third orifice of the orifice plate 311 may be a filling orifice that directs fuel out of the nozzle area 329 into the control valve plate 310, which may balance pressure across the orifice plate 311. When the solenoid 331 inside the solenoid valve 309 receives an electrical current controlled by the ECU 106, the current creates an electromagnetic force that may move the piston-like rod 335 in an upstream direction, which may allow high pressure fuel to flow upstream from the control volume 353 through the second orifice and from nozzle volume 350 through the third orifice of the orifice plate 311, for example. When high pressure fuel flows out of the control volume 353, pressure inside the control volume 353 may decrease to a pressure less than a pressure of the fuel inside the nozzle volume 350. A force from the pressure change across the needle 354 may overcome a force of the nozzle spring 352 and lift the needle 354 in an upstream direction, which may allow fuel to inject into the combustion chamber. When the electrical current is shut off by the ECU 106, the solenoid 331 inside the solenoid valve 309 may cease to generate the electromagnetic force. The piston-like rod 335 may return to an initial position in contact with the orifice plate 311, which may halt high pressure fuel from flowing out of the control volume 353. As a result, the pressure inside the control volume 353, may re-equilibrate with the pressure of the fuel inside the nozzle volume 350. In the absence of the pressure differential, the nozzle spring 352 may extend to its original position, which may move the needle 354 to its original position against the nozzle tip 314; therefore, blocking fuel from entering the combustion chamber.

The nozzle area 329, downstream of the fuel injector end 327, includes the nozzle control area 312 with the nozzle spring 352 and the nozzle needle 354 disposed therein. The pair of low pressure leakage bores 315 are partially positioned in the nozzle area 329 and extend upstream into the fuel injector end 327 and fuel injector body 325, with a pair of outlets 337 of the leakage bores 315 positioned in the fuel injector body 325. Fuel that travels through the solenoid valve 309 during an injection event flows into the low pressure fuel bores 315 and may return to the fuel tank, for example, the fuel tank 102 of FIG. 1, via the leakage outlets 337. The nozzle 313 protrudes from the nozzle area 329 of the housing 321 and includes the nozzle tip 314. The nozzle control area 312 also includes the nozzle volume 350, to which fuel is dispensed from high pressure fuel passages 308. The nozzle spring 352, and the nozzle needle 354 may be arranged in the nozzle volume 350, occupying at least a portion of a volume of the nozzle volume 350. The nozzle volume 350 and the nozzle needle 354 extend entirely through a length (e.g., defined along the central axis of rotation 302) of the nozzle 313.

During a nominal fuel injection event, e.g., fuel injection providing a stoichiometric or target AFR for combustion and at a desired timing, a fuel injector, such as, for example, the fuel injector 300 of FIG. 3, injects fuel into a cylinder of an engine, which is then combusted to provide power to a vehicle. High pressure fuel from a common rail fuel system enters the fuel injector via a fuel inlet in the fuel injector head. Fuel may flow through a filter positioned at the fuel inlet, where debris and other particles are removed. The filtered fuel is then deposited into an internal accumulator, which stores the high pressure fuel prior to injection into the cylinder. During fuel injection, a flow limiting valve may be nominally in an open position, allowing fuel to flow therethrough and into a pair of high pressure fuel passages which may direct high pressure fuel around a solenoid to an inner channel of a nozzle of the fuel injector. A control valve plate is arranged in the fuel injector end and may be fixedly coupled to an orifice plate which may have a diameter similar to a diameter of the inner channel. The high pressure fuel passages direct fuel through both the control valve and the orifice plate.

The orifice plate may direct high pressure fuel to or from one or more of three elements coupled to the orifice plate, including the control volume, the control valve plate, and the nozzle area. When the solenoid is energized, high pressure fuel may be directed out of the control volume into the control valve plate, which may cause the pressure upstream of the top of the nozzle needle to be lower than the pressure at the bottom of the nozzle needle, lifting the needle and causing the injector to inject fuel into the combustion chamber. When the fuel injector is in a deactivated state, e.g., not injecting fuel and with the solenoid de-energized, fuel may be restricted from flowing through the outlet orifice, which may equalize pressure in the control volume upstream of the top of the nozzle needle and the pressure at the bottom of the nozzle needle. As a result, the nozzle needle may remain in a closed position, sealed against the nozzle tip.

A controller may receive a signal from one or more engine sensors indicating that fuel combustion is desired and, in response, may actuate (e.g., energize) the solenoid, which may cause the piston-like rod inside the solenoid valve to move upstream along a longitudinal axis, e.g., along a central axis of rotation, of the fuel injector. The upstream movement of the piston-like rod inside the solenoid valve may also allow fuel from the control volume at the top of the nozzle needle to flow out of the control volume, upstream through the orifice plate into the control valve plate. Fuel flow out of the control volume may create a pressure drop about the nozzle needle, which may result in retraction of the nozzle needle away from a nozzle tip of the fuel injector. With each activation of the solenoid, high pressure fuel is thereby injected from the fuel injector into the cylinder. A volume of fuel not injected into the cylinder that is therefore depressurized to low pressure fuel may return to the fuel tank, via the pair of low pressure leakage bores.

In some instances, an overfueling event may occur during engine operation. As described above, the overfueling event may occur due to, for example, degradation of the fuel injector, an erroneous calculation of fuel injection volume and/or timing, a presence of fuel leaks degraded sensors, a mechanical deterioration of the nozzle tip as a result of fatigue fracture or secondary damage, etc., leading to injection of excess fuel. The flow limiting valve may be configured to cut off fuel injection when an overfueling event is detected. In one example, a spring controlled mechanism of the flow limiting valve may be pressure actuated and therefore compress and expand based on changes in pressure across the spring. During the overfueling event, the pressure above the flow limiting valve may be higher than the pressure below the flow limiting valve, which may cause the flow limiting valve to be activated, blocking fuel flow from the internal accumulator to the fuel lines. Any fuel remaining in the internal accumulator may therefore remain in the internal accumulator upon activation of the flow limiting valve, thereby minimizing a residual amount of fuel that may drip into the cylinder from the fuel injector during the overfueling event.

In this way, a fatigue strength and pressure tolerance of a fuel injector may be maintained in spite of a reduced outer diameter at a head of the fuel injector. By positioning an inner component with a large footprint, such as a flow limiting valve, spaced away from and distal to the fuel injector head, components enclosed within the head may be sufficiently small in volume to allow the head to maintain a threshold wall thickness of the fuel injector housing. As a result, the fuel injector may have sufficient wall strength to withstand high pressures at all regions of the housing. In one example, the flow limiting valve may be situated downstream of an internal chamber of the fuel injector, the internal chamber extending between a filter arranged at an inlet of the fuel injector and the flow limiting valve. An inner volume of the internal chamber is thereby positioned entirely upstream of the flow limiting valve. When overfueling is detected and the flow limiting valve is activated to cut off fuel flow to a cylinder, a residual fuel volume emptied into the cylinder is reduced to a small volume of fuel within a pair of high pressure fuel passages and an inner channel of a nozzle of the fuel injector. This configuration may reduce a likelihood of undesirable events, such as over combustion or hydro-lock.

The technical effect of positioning the flow limiting valve downstream of the internal chamber of the fuel injector is that fuel injector longevity is increased while maintaining engine integrity.

The claims in paragraph format are given below: The disclosure also provides support for a fuel injector, comprising: a housing, an inner chamber enclosed by the housing, and a flow limiting valve arranged at a downstream end of the inner chamber and also enclosed by the housing, wherein the flow limiting valve is positioned between the downstream end of the inner chamber and a solenoid valve. In a first example of the system, an inlet of the fuel injector is located at a first, upstream end of the fuel injector and wherein fuel flows through the fuel injector from the first end, to a second end of the fuel injector, opposite of the first end. In a second example of the system, optionally including the first example, the housing has a head at a top end of the housing, the head arranged upstream of a body of the housing, and wherein an outer diameter of the housing is reduced at the head. In a third example of the system, optionally including one or both of the first and second examples, a first thickness of the housing at the head is less than a second thickness of the housing at the body by an amount equal to or less than a threshold difference. In a fourth example of the system, optionally including one or more or each of the first through third examples, the threshold difference is between 5 to 25%. In a fifth example of the system, optionally including one or more or each of the first through fourth examples, a filter is enclosed by the head of the housing and the inner chamber, the flow limiting valve, and the solenoid valve are enclosed by the body of the housing. In a sixth example of the system, optionally including one or more or each of the first through fifth examples, the flow limiting valve is spaced away from a filter of the fuel injector by a length of the inner chamber, the length defined along a central axis of the fuel injector. In a seventh example of the system, optionally including one or more or each of the first through sixth examples, fuel is stored in the inner chamber, upstream of the flow limiting valve.

The disclosure also provides support for a common rail fuel system for an engine, comprising: a high pressure fuel rail, and a fuel injector configured to inject fuel from the high pressure fuel rail into a cylinder, the fuel injector including, a filter positioned at an inlet of the fuel injector, the inlet located at a first end of the fuel injector, a flow limiting valve arranged in a mid-region along a length of the fuel injector, upstream of a solenoid valve, the flow limiting valve configured as a fuel cutoff during an overfueling event, and an accumulator extending between the filter and the flow limiting valve. In a first example of the system, the flow limiting valve is configured to close when the overfueling event is detected and wherein when closed, the flow limiting valve blocks flow of fuel from the accumulator to the cylinder. In a second example of the system, optionally including the first example, fuel is not stored downstream of the flow limiting valve, between the flow limiting valve and the solenoid valve. In a third example of the system, optionally including one or both of the first and second examples, the flow limiting valve is spaced away from the filter by a length of the accumulator, the length parallel with a central axis of the fuel injector, and wherein the length of the accumulator is greater than either of a length of the filter and a length of the flow limiting valve. In a fourth example of the system, optionally including one or more or each of the first through third examples, the flow limiting valve is positioned closer to a second end of the fuel injector than the first end, the second end opposite of the first end and wherein the second end includes a nozzle. In a fifth example of the system, optionally including one or more or each of the first through fourth examples, the flow limiting valve is fluidly coupled to the nozzle by high pressure fuel passages and wherein fuel flow to the nozzle is adjusted based on a position of an orifice plate arranged in a path of the fuel flow between the solenoid valve and the nozzle. In a sixth example of the system, optionally including one or more or each of the first through fifth examples, the solenoid valve includes an electromagnetically actuated solenoid and a control valve plate coupled to the orifice plate and wherein the solenoid is configured to vary a position of a piston-like rod along a central axis of the fuel injector to create a pressure drop in a control volume above a nozzle needle and wherein creating the pressure drop causes the nozzle needle to lift from its seat and initiate fuel injection into the cylinder. In a seventh example of the system, optionally including one or more or each of the first through sixth examples, the flow limiting valve is configured to block fuel flow from the accumulator to the nozzle, independent of the position of the orifice plate, when the overfueling event is detected.

The disclosure also provides support for a fuel injector for a common rail fuel system, comprising: a housing enclosing a plurality of inner components of the fuel injector, the plurality of inner components including a flow limiting valve arranged in between an accumulator and a solenoid valve of the fuel injector, wherein a thickness of a wall of the housing is thinner at a head of the fuel injector than at a body of the fuel injector by an amount equal to or less than a threshold difference. In a first example of the system, the head of the fuel injector is circumferentially surrounded by a clamp, the clamp configured to maintain a position of the fuel injector in a cylinder head and wherein an outer diameter of the head of the fuel injector is reduced relative to an outer diameter of the body of the fuel injector. In a second example of the system, optionally including the first example, the head of the fuel injector extends between an inlet of the fuel injector and the body of the fuel injector and wherein the thickness of the wall of the housing at the head is configured to withstand a high pressure of the common fail fuel system communicated to the fuel injector at the inlet of the fuel injector. In a third example of the system, optionally including one or both of the first and second examples, fuel is stored in the fuel injector entirely upstream of the flow limiting valve during operation of the fuel injector and during an overfueling event when the flow limiting valve is actuated to cut off fuel injection at a cylinder.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A fuel injector, comprising:

a housing;

an inner chamber enclosed by the housing wherein the inner chamber has a first portion situated within a fuel injector head and a second portion situated within a fuel injector body; and a flow limiting valve arranged at a downstream end of the inner chamber and also enclosed by the housing, wherein the flow limiting valve is positioned between the downstream end of the inner chamber and a solenoid valve.

2. The fuel injector of claim 1, wherein an inlet of the fuel injector is located at a first, upstream end of the fuel injector and wherein fuel flows through the fuel injector from the first end, to a second end of the fuel injector, opposite of the first end.

3. The fuel injector of claim 1, wherein the housing has a head at a top end of the housing, the head arranged upstream of a body of the housing, and wherein an outer diameter of the housing is reduced at the head relative to an outer diameter of the body.

4. The fuel injector of claim 3, wherein a first thickness of the housing at the head is less than a second thickness of the housing at the body by an amount equal to or less than a threshold difference.

5. The fuel injector of claim 4, wherein the threshold difference is between 5 to 25%.

6. The fuel injector of claim 3, wherein a filter is enclosed by the head of the housing and the inner chamber, the flow limiting valve, and the solenoid valve are enclosed by the body of the housing.

7. The fuel injector of claim 1, wherein the flow limiting valve is spaced away from a filter of the fuel injector by a length of the inner chamber, the length defined along a central axis of the fuel injector.

8. The fuel injector of claim 1, wherein fuel is stored in the inner chamber, upstream of the flow limiting valve.

9. A common rail fuel system for an engine, comprising:

a high pressure fuel rail; and a fuel injector configured to inject fuel from the high pressure fuel rail into a cylinder, the fuel injector including:

a filter positioned at an inlet of the fuel injector, the inlet located at a first end of the fuel injector, wherein the filter is upstream of an internal accumulator with a first portion of the internal accumulator situated within the fuel injector head and a second portion of the internal accumulator situated with the fuel injector body;

a flow limiting valve arranged in a mid-region along a length of the fuel injector, upstream of a solenoid valve, the flow limiting valve configured as a fuel cutoff during an overfueling event; and an accumulator extending between the filter and the flow limiting valve.

10. The common rail fuel system of claim 9, wherein the flow limiting valve is configured to close when the overfueling event is detected and wherein when closed, the flow limiting valve blocks flow of fuel from the accumulator to the cylinder.

11. The common rail fuel system of claim 9, wherein fuel is not stored downstream of the flow limiting valve, between the flow limiting valve and the solenoid valve.

12. The common rail fuel system of claim 9, wherein the flow limiting valve is spaced away from the filter by a length of the accumulator, the length parallel with a central axis of the fuel injector, and wherein the length of the accumulator is greater than either of a length of the filter and a length of the flow limiting valve.

13. The common rail fuel system of claim 9, wherein the flow limiting valve is positioned closer to a second end of the fuel injector than the first end, the second end opposite of the first end and wherein the second end includes a nozzle.

14. The common rail fuel system of claim 13, wherein the flow limiting valve is fluidly coupled to the nozzle by high pressure fuel passages and wherein fuel flow to the nozzle is adjusted based on a position of an orifice plate arranged in a path of the fuel flow between the solenoid valve and the nozzle.

15. The common rail fuel system of claim 14, wherein the solenoid valve includes an electromagnetically actuated solenoid and a control valve plate coupled to the orifice plate and wherein the solenoid is configured to vary a position of a piston-like rod along a central axis of the fuel injector to create a pressure drop in a control volume above a nozzle needle and wherein creating the pressure drop causes the nozzle needle to lift from its seat and initiate fuel injection into the cylinder.

16. The common rail fuel system of claim 13, wherein the flow limiting valve is configured to block fuel flow from the accumulator to the nozzle, independent of the position of the orifice plate, when the overfueling event is detected.

17. A fuel injector for a common rail fuel system, comprising:

a housing enclosing a plurality of inner components of the fuel injector, the plurality of inner components including a flow limiting valve arranged in between an accumulator and a solenoid valve of the fuel injector, wherein a thickness of a wall of the housing is thinner at a head of the fuel injector than at a body of the fuel injector by an amount equal to or less than a threshold difference, wherein the accumulator has a first portion situated within a fuel injector head and a second portion situated within a fuel injector body, and wherein the first portion has a length that is less than the length of the second portion.

18. The fuel injector of claim 17, wherein the head of the fuel injector is circumferentially surrounded by a clamp, the clamp configured to maintain a position of the fuel injector in a cylinder head and wherein an outer diameter of the head of the fuel injector is reduced relative to an outer diameter of the body of the fuel injector.

19. The fuel injector of claim 17, wherein the head of the fuel injector extends between an inlet of the fuel injector and the body of the fuel injector and wherein the thickness of the wall of the housing at the head is configured to withstand a high pressure of the common fail fuel system communicated to the fuel injector at the inlet of the fuel injector.

20. The fuel injector of claim 17, wherein fuel is stored in the fuel injector entirely upstream of the flow limiting valve during operation of the fuel injector and during an overfueling event when the flow limiting valve is actuated to cut off fuel injection at a cylinder, and wherein during the overfueling event, an excess of fuel is injected relative to a target fueling quantity.

* * * * *